US009190773B2

(12) United States Patent
Shaw

(10) Patent No.: US 9,190,773 B2
(45) Date of Patent: Nov. 17, 2015

(54) SOCKETED NUT COAXIAL CONNECTORS WITH RADIAL GROUNDING SYSTEMS FOR ENHANCED CONTINUITY

(75) Inventor: Glen David Shaw, Conway, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 0 days.

(21) Appl. No.: 13/589,666

(22) Filed: Aug. 20, 2012

(65) Prior Publication Data

US 2013/0164962 A1 Jun. 27, 2013

Related U.S. Application Data

(63) Continuation-in-part of application No. 13/374,378, filed on Dec. 27, 2011, now Pat. No. 8,636,541.

(51) Int. Cl.
*H01R 13/622* (2006.01)
*H01R 13/24* (2006.01)
*H01R 13/17* (2006.01)

(52) U.S. Cl.
CPC ..... *H01R 13/622* (2013.01); *H01R 13/2421* (2013.01); *H01R 13/17* (2013.01)

(58) Field of Classification Search
CPC ..... H01R 13/2421
USPC ..... 439/578, 583–585
See application file for complete search history.

(56) References Cited

U.S. PATENT DOCUMENTS

| | | | |
|---|---|---|---|
| 2,280,728 | A | 4/1942 | Streib |
| D148,897 | S | 3/1948 | Ward |
| 2,757,351 | A | 7/1956 | Klostermann |
| D181,302 | S | 10/1957 | Logan |
| 2,858,358 | A | 10/1958 | Hawke |
| 3,184,706 | A | 5/1965 | Atkins |
| 3,199,061 | A | 8/1965 | Johnson |
| 3,292,136 | A | 12/1966 | Somerset |
| 3,332,052 | A | 7/1967 | Rusinyak |
| 3,373,243 | A | 3/1968 | Janowiak |
| 3,375,485 | A | 3/1968 | Donohue |
| 3,448,430 | A | 6/1969 | Kelly |
| 3,498,647 | A | 3/1970 | Schroder |
| 3,512,224 | A | 5/1970 | Newton |
| 3,522,576 | A | 8/1970 | Cairns |
| 3,537,065 | A | 10/1970 | Winston |
| 3,609,637 | A | 9/1971 | Cole |
| 3,665,371 | A | 5/1972 | Cripps |

(Continued)

FOREIGN PATENT DOCUMENTS

| | | |
|---|---|---|
| EP | 0542102 | 5/1993 |
| WO | WO 9014697 | 11/1990 |

(Continued)

*Primary Examiner* — Ross Gushi
(74) *Attorney, Agent, or Firm* — Ocean Law; Paul D. Chancellor

(57) ABSTRACT

Axially compressible F-connectors for conventional installation tools for interconnection with coaxial cable include radially compressed grounding inserts seated within a body fitted to a nut socket. Each connector has a rigid nut, a post penetrating the nut, a tubular, metallic body, and an end cap. The conductive post coaxially extends through the connectors, linking the nut and body. A post end penetrates the coaxial cable. The nut has an integral, tubular socket at its rear that is engaged by a tubular, metallic connector body. The body front has at least one groove for receiving a peripheral grounding insert, preferably in the form of a coiled spring wrapped around the body, that is radially sandwiched within the nut socket to insure grounding. An end cap press fitted to the assembly coaxially engaging the body, closing the fitting. Internal O-rings may be combined for sealing the connector.

15 Claims, 9 Drawing Sheets

(56) References Cited

U.S. PATENT DOCUMENTS 3,668,612 A 6/1972 Nepovim
3,671,922 A 6/1972 Zerlin
3,671,926 A 6/1972 Nepovim
3,678,445 A 7/1972 Brancaleone
3,678,446 A 7/1972 Siebeliest
3,681,739 A 8/1972 Komick
3,686,623 A 8/1972 Nijman
3,710,005 A 1/1973 French
3,739,076 A 6/1973 Schwartz
3,740,453 A 6/1973 Callaghan
3,835,442 A 9/1974 Anderson et al.
3,835,443 A 9/1974 Arnold
3,846,738 A 11/1974 Nepovim
3,879,102 A 4/1975 Horak
3,976,352 A 8/1976 Spinner
D241,341 S 9/1976 Oxley
3,985,418 A 10/1976 Spinner
3,986,737 A 10/1976 Krusche
4,106,839 A 8/1978 Cooper
4,128,293 A 12/1978 Oaoli
4,280,749 A 7/1981 Hemmer
4,329,540 A 5/1982 Howarth
4,330,166 A 5/1982 Cooper
4,423,919 A 1/1984 Hillis
4,426,127 A 1/1984 Kubota
4,525,000 A 6/1985 Bachle
4,531,805 A 7/1985 Werth
4,583,811 A 4/1986 McMills
4,593,964 A 6/1986 Forney, Jr.
4,630,806 A 12/1986 Dan
4,648,684 A 3/1987 Mattis
4,684,201 A 8/1987 Hutter
4,698,028 A 10/1987 Caro
4,703,988 A 11/1987 Raux
4,746,305 A 5/1988 Nomura
RE32,787 E 11/1988 Gallusser
4,808,128 A 2/1989 Werth
4,813,716 A 3/1989 Lalikos
4,834,675 A 5/1989 Samchisen
4,936,788 A 6/1990 Lin
4,952,174 A 8/1990 Sucht
D313,222 S 12/1990 Takizawa
4,979,911 A 12/1990 Spencer
4,990,106 A 2/1991 Szegda
5,002,503 A 3/1991 Campbell
5,011,422 A 4/1991 Yeh
5,024,606 A 6/1991 Ming
5,043,696 A 8/1991 Wang
5,061,191 A * 10/1991 Casciotti et al. ..... 439/66
5,066,248 A 11/1991 Gaver, Jr.
5,078,623 A 1/1992 Wang
5,083,943 A 1/1992 Tarrant
5,088,936 A 2/1992 Wang
5,112,250 A 5/1992 Wang
D327,872 S 7/1992 McMills
5,167,525 A 12/1992 Wang
5,167,536 A 12/1992 Wang
5,192,226 A 3/1993 Wang
5,219,299 A 6/1993 Wang
5,226,838 A 7/1993 Hsu
D339,568 S 9/1993 Salz
5,270,487 A 12/1993 Sawmura
5,321,207 A 6/1994 Huang
5,340,325 A 8/1994 Pai
5,342,096 A 8/1994 Bachle
5,383,798 A 1/1995 Lin
5,387,116 A 2/1995 Wang
5,387,127 A 2/1995 Wang
5,389,012 A 2/1995 Huang
5,397,252 A 3/1995 Wang
5,413,502 A 5/1995 Wang
5,430,618 A 7/1995 Huang
5,438,251 A 8/1995 Chen
5,470,257 A 11/1995 Szegda
5,478,258 A 12/1995 Wang
5,498,175 A 3/1996 Yeh
5,599,198 A 2/1997 Wang
5,600,094 A 2/1997 McCabe
5,613,880 A 3/1997 Wang
5,632,651 A 5/1997 Szegda
5,667,409 A 9/1997 Wong
5,683,263 A 11/1997 Hsu
5,702,261 A 12/1997 Wang
5,722,856 A 3/1998 Fuchs
5,723,818 A 3/1998 Yeh
5,730,621 A 3/1998 Wang
5,769,652 A 6/1998 Wider
5,803,757 A 9/1998 Wang
5,820,408 A 10/1998 Wang
5,863,226 A 1/1999 Lan
5,879,166 A 3/1999 Wang
5,924,889 A 7/1999 Wang
5,934,137 A 8/1999 Tarpill
5,951,319 A 9/1999 Lin
5,957,730 A 9/1999 Wang
5,975,949 A 11/1999 Holliday
5,975,951 A 11/1999 Burris
5,980,308 A 11/1999 Hu
5,997,350 A 12/1999 Burris
6,024,588 A 2/2000 Hsu
6,065,976 A 5/2000 Wang
6,095,869 A 8/2000 Wang
6,113,431 A 9/2000 Wong
6,139,344 A 10/2000 Wang
6,146,197 A 11/2000 Holliday
6,153,830 A 11/2000 Montena
6,159,046 A 12/2000 Wong
D436,076 S 1/2001 Montena
6,179,656 B1 1/2001 Wong
D437,826 S 2/2001 Montena
D440,539 S 4/2001 Montena
D440,939 S 4/2001 Montena
6,234,838 B1 5/2001 Wong
6,276,970 B1 8/2001 Wong
6,287,148 B1 9/2001 Huang
6,332,815 B1 12/2001 Bruce
6,386,912 B1 5/2002 Li
6,390,840 B1 5/2002 Wang
D458,904 S 6/2002 Montena
6,402,155 B2 6/2002 Sakata
6,406,330 B2 6/2002 Bruce
D460,739 S 7/2002 Fox
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,599 B1 11/2002 Lee
6,478,618 B2 11/2002 Wong
6,488,317 B1 12/2002 Daoud
D468,696 S 1/2003 Montena
6,530,807 B2 3/2003 Rodrigues
6,558,194 B2 5/2003 Montena
D475,975 S 6/2003 Fox
D475,976 S 6/2003 Montena
D475,977 S 6/2003 Montena
6,634,906 B1 10/2003 Yeh
6,676,443 B1 1/2004 Wang
6,716,062 B1 4/2004 Palinkas
6,733,336 B1 5/2004 Montena
6,767,247 B2 7/2004 Rodrigues
6,767,248 B1 7/2004 Hung
6,767,249 B1 7/2004 Li
6,769,926 B1 8/2004 Montena
6,776,650 B2 8/2004 Cheng
6,776,657 B1 8/2004 Hung
6,776,665 B2 8/2004 Huang
6,780,052 B2 8/2004 Montena
6,789,653 B1 9/2004 Hsu
6,793,526 B1 9/2004 Hsu
6,799,995 B2 10/2004 Hsu
6,805,584 B1 10/2004 Chen
6,817,897 B2 11/2004 Chee

(56) References Cited

U.S. PATENT DOCUMENTS

| | | | | |
|---|---|---|---|---|
| 6,830,479 | B2 | 12/2004 | Holliday | |
| 6,848,939 | B2 | 2/2005 | Stirling | |
| 6,848,940 | B2 | 2/2005 | Montena | |
| 6,860,751 | B1 | 3/2005 | Huang | |
| D503,685 | S | 4/2005 | Montena | |
| D504,113 | S | 4/2005 | Montena | |
| D504,114 | S | 4/2005 | Montena | |
| D504,402 | S | 4/2005 | Montena | |
| 6,881,075 | B2 | 4/2005 | Huang | |
| 6,884,113 | B1 | 4/2005 | Montena | |
| D505,391 | S | 5/2005 | Rodrigues | |
| 6,887,090 | B2 | 5/2005 | Lin | |
| D506,446 | S | 6/2005 | Montena | |
| 6,908,337 | B1 | 6/2005 | Li | |
| 6,910,919 | B1 | 6/2005 | Hung | |
| D507,242 | S | 7/2005 | Montena | |
| 6,929,501 | B2 | 8/2005 | Huang | |
| 6,929,507 | B2 | 8/2005 | Lin | |
| 6,935,874 | B1 | 8/2005 | Fang | |
| 6,935,878 | B2 | 8/2005 | Hsu | |
| 6,948,969 | B2 | 9/2005 | Huang | |
| 6,948,973 | B1 | 9/2005 | Hsu | |
| 6,951,469 | B1 | 10/2005 | Lin | |
| 6,956,464 | B2 | 10/2005 | Wang | |
| D511,497 | S | 11/2005 | Murphy | |
| D511,498 | S | 11/2005 | Holliday | |
| D512,024 | S | 11/2005 | Murphy | |
| D512,689 | S | 12/2005 | Murphy | |
| D513,406 | S | 1/2006 | Rodrigues | |
| D513,736 | S | 1/2006 | Fox | |
| D514,071 | S | 1/2006 | Vahey | |
| D515,037 | S | 2/2006 | Fox | |
| 6,994,588 | B2 | 2/2006 | Montena | |
| 7,001,204 | B1 | 2/2006 | Lin | |
| 7,004,765 | B2 | 2/2006 | Hsu | |
| 7,004,777 | B2 | 2/2006 | Hsu | |
| 7,008,263 | B2 | 3/2006 | Holland | |
| 7,018,235 | B1 | 3/2006 | Burris | |
| D518,772 | S | 4/2006 | Fox | |
| D519,076 | S | 4/2006 | Fox | |
| D519,451 | S | 4/2006 | Fox | |
| D519,452 | S | 4/2006 | Rodrigues | |
| D519,453 | S | 4/2006 | Rodrigues | |
| D519,463 | S | 4/2006 | Tamezane | |
| 7,021,965 | B1 | 4/2006 | Montena | |
| D521,454 | S | 5/2006 | Murphy | |
| D521,930 | S | 5/2006 | Fox | |
| 7,063,551 | B1 | 6/2006 | Lin | |
| 7,114,990 | B2 | 10/2006 | Bence | |
| 7,118,416 | B2 | 10/2006 | Montena et al. | |
| 7,128,603 | B2 | 10/2006 | Burris | |
| D535,259 | S | 1/2007 | Rodrigues | |
| 7,182,639 | B2 | 2/2007 | Burris | |
| 7,192,308 | B2 | 3/2007 | Rodrigues | |
| D543,948 | S | 6/2007 | Montena | |
| D544,837 | S | 6/2007 | Disbennett | |
| 7,241,172 | B2 | 7/2007 | Rodrigues | |
| 7,252,546 | B1 | 8/2007 | Holland | |
| 7,255,598 | B2 | 8/2007 | Montena | |
| 7,288,002 | B2 | 10/2007 | Rodrigues | |
| 7,303,436 | B1 | 12/2007 | Li | |
| 7,356,638 | B2 | 4/2008 | Holland | |
| 7,364,462 | B2 | 4/2008 | Holland | |
| 7,371,113 | B2 | 5/2008 | Burris | |
| 7,479,035 | B2 | 1/2009 | Bence | |
| 7,507,117 | B2 | 3/2009 | Amidon | |
| 7,513,795 | B1 | 4/2009 | Shaw | |
| D601,966 | S | 10/2009 | Shaw | |
| D601,967 | S | 10/2009 | Shaw | |
| D607,826 | S | 1/2010 | Shaw | |
| D607,827 | S | 1/2010 | Shaw | |
| D607,828 | S | 1/2010 | Shaw | |
| D607,829 | S | 1/2010 | Shaw | |
| D607,830 | S | 1/2010 | Shaw | |
| D608,294 | S | 1/2010 | Shaw | |
| 7,753,705 | B2 | 7/2010 | Montena | |
| 7,824,216 | B2 | 11/2010 | Purdy | |
| 7,841,896 | B2 | 11/2010 | Shaw et al. | |
| 7,845,976 | B2 | 12/2010 | Matthews | |
| 7,892,005 | B2 | 2/2011 | Haube | |
| 7,892,024 | B1 | 2/2011 | Chen | |
| 7,931,509 | B2 | 4/2011 | Shaw et al. | |
| 7,955,126 | B2 | 6/2011 | Bence | |
| 8,029,315 | B2 * | 10/2011 | Purdy et al. | 439/578 |
| 8,231,412 | B2 * | 7/2012 | Paglia et al. | 439/607.17 |
| 8,337,229 | B2 * | 12/2012 | Montena | 439/322 |
| 8,366,481 | B2 * | 2/2013 | Ehret et al. | 439/578 |
| 2002/0146935 | A1 | 10/2002 | Wong | |
| 2003/0092319 | A1 | 5/2003 | Hung | |
| 2003/0194902 | A1 | 10/2003 | Huang | |
| 2003/0236027 | A1 | 12/2003 | Wang | |
| 2004/0053533 | A1 | 3/2004 | Huang | |
| 2004/0067688 | A1 | 4/2004 | Cheng | |
| 2004/0077215 | A1 | 4/2004 | Palinkas | |
| 2004/0102095 | A1 | 5/2004 | Huang | |
| 2004/0147164 | A1 | 7/2004 | Li | |
| 2004/0171297 | A1 | 9/2004 | Hsu | |
| 2004/0171315 | A1 | 9/2004 | Liao | |
| 2004/0224556 | A1 | 11/2004 | Qin | |
| 2005/0009379 | A1 | 1/2005 | Huang | |
| 2005/0020121 | A1 | 1/2005 | Lin | |
| 2005/0032410 | A1 | 2/2005 | Huang | |
| 2005/0070145 | A1 | 3/2005 | Huang | |
| 2005/0075012 | A1 | 4/2005 | Hsu | |
| 2005/0153587 | A1 | 7/2005 | Hsu | |
| 2005/0159030 | A1 | 7/2005 | Hsu | |
| 2005/0186852 | A1 | 8/2005 | Hsu | |
| 2005/0186853 | A1 | 8/2005 | Hsu | |
| 2005/0202690 | A1 | 9/2005 | Lien | |
| 2005/0202699 | A1 | 9/2005 | Hsu | |
| 2005/0233632 | A1 | 10/2005 | Hsu | |
| 2005/0250357 | A1 | 11/2005 | Chen | |
| 2005/0260894 | A1 | 11/2005 | Chen | |
| 2006/0094300 | A1 | 5/2006 | Hsu | |
| 2006/0110977 | A1 * | 5/2006 | Matthews | 439/578 |
| 2006/0121753 | A1 | 6/2006 | Chiang | |
| 2006/0121763 | A1 | 6/2006 | Chiang | |
| 2006/0292926 | A1 | 12/2006 | Chee et al. | |
| 2009/0098770 | A1 | 4/2009 | Bence | |
| 2011/0021072 | A1 | 1/2011 | Purdy | |
| 2012/0040537 | A1 * | 2/2012 | Burris | 439/11 |
| 2012/0202378 | A1 * | 8/2012 | Krenceski et al. | 439/578 |
| 2013/0012063 | A1 * | 1/2013 | Thomas et al. | 439/578 |
| 2013/0102188 | A1 * | 4/2013 | Montena | 439/578 |
| 2013/0115795 | A1 * | 5/2013 | Ehret et al. | 439/274 |
| 2013/0183857 | A1 * | 7/2013 | Ehret et al. | 439/578 |
| 2013/0237089 | A1 * | 9/2013 | Lu | 439/578 |

FOREIGN PATENT DOCUMENTS

| | | |
|---|---|---|
| WO | WO 93/05547 | 3/1993 |
| WO | WO 93/24973 | 12/1993 |
| WO | WO 96/20516 | 7/1996 |
| WO | WO 96/20518 | 7/1996 |
| WO | WO 97/22162 | 6/1997 |
| WO | WO/99/065117 | 12/1999 |
| WO | WO/99/65118 | 12/1999 |
| WO | WO/03/096484 | 11/2003 |
| WO | WO/2005/083845 | 9/2005 |

* cited by examiner 20
21
24
26
28
29
30
33
34
35
37
38
40
41
42
43
44
46
48
50
52
56
60
64
65
66
67
68
69
70
71
72
73
74
75
76
77
79
85
87
88
90
91

SOCKETED NUT COAXIAL CONNECTORS WITH RADIAL GROUNDING SYSTEMS FOR ENHANCED CONTINUITY

CROSS REFERENCE TO RELATED APPLICATION

This utility patent application is a Continuation-in-Part of U.S. utility patent application Ser. No. 13/374,378, filed Dec. 27, 2011 now U.S. Pat. No. 8,636,541, entitled "Enhanced Coaxial Connector Continuity," by coinventors Robert J. Chastain and Glen David Shaw, which has been assigned to the same assignee as in this case (i.e., Perfectvision Manufacturing, Inc.).

BACKGROUND OF THE INVENTION

1. Field of the Invention

The present invention relates generally to coaxial cable connectors. More particularly, the present invention relates to coaxial F-connectors adapted to insure the establishment of a proper ground during installation. Known prior art is classified in United States Patent Class 439, Subclasses 241, 247, 322, 548, 553, 554, 585, and 587.

2. Description of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of receptacles, forming the "female" portion of the connection.

F-connectors include a tubular post designed to slide over coaxial cable dielectric material and under the outer conductor at the prepared end of the coaxial cable. The exposed, conductive sheath is usually folded back over the cable jacket. The cable jacket and folded-back outer conductor extend generally around the outside of the tubular post and are typically coaxially received within the tubular connector. A continuity contact between the sheath and the body of the connector is needed. Moreover, contact must be made with the threaded head or nut of the connector that should contact the female socket to which the connection is made.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 548.

However, the extremely high bandwidths and frequencies distributed in conjunction with modern satellite installations necessitate a variety of strict quality control factors. For example, the electrical connection established by the F-connector must not add electrical resistance to the circuit. It must exhibit a proper surge impedance to maintain a wide bandwidth, in the order of several Gigahertz. Numerous physical design requirements exist as well. For example, connectors must maintain a proper seal against the environment, and they must function over long time periods through extreme weather and temperature conditions. Requirements exist governing frictional insertion and disconnection or withdrawal forces as well.

Importantly, since a variety of coaxial cable diameters exist, it is imperative that satisfactory F-connectors function with differently sized cables, such as RG-6 and RG-59 coaxial cables that are most popular in the satellite television art.

It is important to establish an effective electrical connection between the F-connector, the internal coaxial cable, and the terminal socket. One facet of the problem involves electrical continuity that must be established between the connector nut and the usually-barbed post within the connector. More particularly, it is important to establish a dependable electrical connection between the front nut, the internal post, the post shank, and the coaxial cable sheath.

Proper installation techniques require adequate torquing of the connector head. In other words, it is desired that the installer appropriately tighten the connector during installation. A dependable electrical grounding path must be established through the connector body to the grounded shield or jacket of the coaxial cable. Threaded F-connector nuts should be installed with a wrench to establish reasonable torque settings. Critical tightening of the F-connector nut to the threaded female socket or fixture applies enough pressure between internal parts and the inner conductor of the coaxial cable to establish proper electrical connections. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

Many connector installations, however, are not properly completed. It is a simple fact in the satellite and cable television industries that many F-connectors are not appropriately tightened by the installer. A common installation technique is to torque the F-connector with a small wrench. In some cases installers only partially tighten the F-connector. Some installations are only hand-tightened. As a consequence, proper electrical continuity may not be achieved. Such F-connectors will not be properly "grounded," and the electrical grounding path can be compromised and intermittent. An appropriate low resistance, low loss connection to the female target socket, and the equipment connected to it, will not be established. Unless a proper ground path is established, poor signal quality, and RFI leakage, will result. This translates to signal loss or degradation to the customer.

U.S. Pat. No. 3,678,445 issued Jul. 18, 1972 discloses a shield for eliminating electromagnetic interference in an electrical connector. A conductive shielding member having a spring portion snaps into a groove for removably securing the shield. A second spring portion is yieldable to provide electrical contact between the first shell member and a second movable shell member.

U.S. Pat. No. 3,835,442 issued Sep. 10, 1974 discloses an electromagnetic interference shield for an electrical connector comprising a helically coiled conductive spring interposed between mating halves of the connector. The coiled spring has convolutions slanted at an oblique angle to the center axis of the connector. Mating of the connector members axially flattens the spring to form an almost continuous metal shield between the connector members.

U.S. Pat. No. 3,739,076 issued Jun. 12, 1973 discloses a coaxial connector with an internal, electrically conductive coil spring mounted between adjacent portions of the connector. As an end member is rotatably threaded toward the housing, an inwardly directed annular bevel engages the spring and moves it inwardly toward an electrically shielded portion of the cable. The spring is compressed circumferentially so that its inner periphery makes electrical grounding contact with the shielded portion of the cable.

U.S. Pat. No. 5,066,248 issued Nov. 19, 1991 discloses a coaxial cable connector comprising a housing sleeve, a connector body, a locking ring, and a center post. A stepped, annular collar on the connector body ensures metal-to-metal contact and grounding.

U.S. Pat. No. 4,106,839 issued Aug. 15, 1978 shows a coaxial connector with a resilient, annular insert between abutting connector pieces for grounding adjacent parts. A band having a cylindrical surface is seated against an internal surface. Folded, resilient projections connected with the band are biased into contact. The shield has tabs for mounting, and a plurality of folded integral, resilient projections for establishing a ground.

U.S. Pat. No. 4,423,919 issued Jan. 3, 1984 discloses a connector having a cylindrical shell with a radial flange, a longitudinal key, and a shielding ring fitted over the shell adjacent the flange. The shielding ring comprises a detent having end faces configured to abut connector portions when the detent fits within the keyway, whereby the shell is prevented from rotating.

U.S. Pat. No. 4,330,166 issued May 18, 1982 discloses an electrical connector substantially shielded against EMP and EMI energy with an internal, conductive spring washer seated in the plug portion of the connector. A wave washer made from beryllium copper alloy is preferred.

U.S. Pat. No. 6,406,330 issued Jun. 18, 2002 employs an internal, beryllium copper clip ring for grounding. The clip ring forms a ground circuit between a male member and a female member of the electrical connector. The clip ring includes an annular body having an inner wall and an outer wall comprising a plurality of circumferentially spaced slots.

U.S. Pat. No. 7,114,990 issued Oct. 3, 2006 discloses a coaxial cable connector with an internal grounding clip establishing a grounding path between an internal tubular post and the connector. The grounding clip comprises a C-shaped metal clip with an arcuate curvature that is non-circular. U.S. Pat. No. 7,479,035 issued Jan. 20, 2009 shows a similar F-connector grounding arrangement.

U.S. Pat. No. 7,753,705 issued Jul. 13, 2010 discloses an RF seal for coaxial connectors. The seal comprises a flexible brim, a transition band, and a tubular insert with an insert chamber defined within the seal. In a first embodiment the flexible brim is angled away from the insert chamber, and in a second embodiment the flexible brim is angled inwardly toward the insert chamber. A flange end of the seal makes compliant contact between the port and connector faces when the nut of a connector is partially tightened, and becomes sandwiched firmly between the ground surfaces when the nut is properly tightened. U.S. Pat. No. 7,892,024 issued Feb. 22, 2011 shows a similar grounding insert for F-connectors.

U.S. Pat. No. 7,824,216 issued Nov. 2, 2010 discloses a coaxial connector comprising a body, a post including a flange with a tapered surface, a nut having an internal lip with a tapered surface which oppositely corresponds to the tapered surface of the post when assembled, and a conductive O-ring between the post and the nut for continuity. Similar U.S. Pat. No. 7,845,976 issued Dec. 7, 2010 and U.S. Pat. No. 7,892,005 issued Feb. 22, 2011 use conductive, internal O-rings for both grounding and sealing.

U.S. Pat. No. 6,332,815 issued Dec. 25, 2001 and U.S. Pat. No. 6,406,330 issued Jun. 18, 2002 utilize clip rings made of resilient, conductive material such as beryllium copper for grounding. The clip ring forms a ground between a male member and a female member of the connector.

U.S. Pat. No. 6,716,062 issued Apr. 6, 2004 discloses a coaxial cable F connector with an internal coiled spring that establishes continuity. The spring biases the nut toward a rest position wherein not more than three revolutions of the nut are necessary to bring the post of the connector into contact.

U.S. Pat. No. 7,841,896 issued Nov. 30, 2010, and entitled "Sealed compression type coaxial cable F-connectors", which is owned by the instant assignee, discloses axially compressible, high bandwidth F-connectors for interconnection with coaxial cable. An internal, dual segment sealing Plunger activated by compression provides a seal. Each connector nut interacts with a tubular body and a rigid, conductive post coaxially extending through the connector. A post barbed end penetrates the cable within the connector. A metallic end cap is slidably fitted to the body. A tactile system comprising external convex projections on the body complemented by a resilient, external O-ring on the end cap aids installers who can properly position connectors with the sense of touch.

For an adequate design, structural improvements to compressible F-connectors for improving continuity or grounding must function reliably without degrading other important connector requirements. Compressible connectors must adequately compress during installation without excessive force. An environmental seal must be established to keep out water. The coaxial cable inserted into the connector must not be mechanically broken or short circuited during installation. Field installers and technicians must be satisfied with the ease of installation. Finally, the bottom line is that a reliable installation must result for customer satisfaction.

As implied from the above-discussed art, many prior art attempts at enhanced grounding exist. Several solutions involve the addition of a conductive grounding member within the fitting that physically and electrically bears against critical parts to enhance continuity. Some forms of grounding involve radially positioned or circuit elements that contribute to an electrical grounding path. Recently, it has become apparent to us that known radial grounding designs directed at the above-discussed continuity problem may not, under certain conditions, adequately insure and establish electrical contact. We have found that, where used, the radial grounding insert must be captivated and peripherally, radially pressured to promote grounding. Further, as recent efforts to insure grounding center upon nut-to-post contact, the radial grounding must be established between the nut and post.

BRIEF SUMMARY OF THE INVENTION

The compressible type coaxial connector described herein comprises a rigid nut with a faceted, drive head adapted to be torqued during installation of a fitting. At its front, the head has an internally threaded, tubular stem, for threadably mating with a typical threaded receptacle. At its rear, the nut comprises an integral, tubular socket. An elongated, internal post within the connector includes a shank that engages the prepared end of a coaxial cable. The post penetrates the nut and is contacted and restrained thereby.

A tubular, metallic connector body has a front region coaxially surrounding the shoulder region of the post, which is lodged coaxially internally of the body. The frontal body region has at least one groove for receiving a peripheral grounding insert, preferably in the form of a coiled spring wrapped around the body and seated with the groove. The same front portion of the metallic body that coaxially surrounds the post is coaxially pressed within the nut socket, such that the insert is radially sandwiched between the body and the nut socket to insure grounding. An end cap is press fitted to the assembly, coaxially engaging the body, and closing the fitting. Internal O-rings, band seals, or the like may be combined for sealing the connector In known F-connector designs the internal post establishes electrical contact between the coaxial cable sheath and metallic parts of the coaxial fitting, such as the nut. Also, the elongated, tubular post shank extends from the post to engage the coaxial cable, making contact with the metallic, insulative sheath. However, since improper or insufficient tightening of the nut during F-connector installation is so common, and since continuity and/or electrical grounding suffer as a result, this connector design provides means for enhancing continuity between functional parts by radially grounding the body within the nut. With the body mated to the nut socket, the radially pressured insert within the annulus insures continuity between the nut (i.e., the nut socket) and the metallic body.

Thus I have provided a coaxial connector utilizing a modified nut that mates with the body, which internally engages the nut socket. The peripheral grounding insert captivated within the body radially establishes continuity between the metallic nut and the coaxially inserted metallic body. When the body is received within the mating socket defined in the nut rear, the grounding insert is radially compressed within an annular clearance region within the socket, and abutting metal contact insures continuity.

Thus the primary object of my invention is to promote electrical continuity within an F-connector to overcome electrical connection problems associated with improper installation.

More particularly, an object of my invention is to provide dependable electrical connections between coaxial connectors, especially F-connectors, and female connectors or sockets.

A basic object is to encourage adequate grounding within F-connectors that are insufficiently tightened during installation.

Another object of the present invention is to provide internal structure for promoting grounding contact between the nut and body within improperly-tightened coaxial cable connectors.

A similar object is to provide a proper continuity in a coaxial connector, even though required torque settings have been ignored.

Another object of the present invention is to provide reliable continuity between a connector and a target port, even if the connector is not fully tightened.

A related object of my invention is to provide suitable grounding within an F-connector to overcome electrical connection problems associated with improper installation.

A still further object of my invention is to provide dependable electrical connections between coaxial connectors, especially F-connectors, and female connectors or sockets.

Another object of the present invention is to provide internal coaxial cable structure for establishing a grounding path in an improperly-tightened coaxial cable connector.

It is another object of the present invention to provide a reliable ground path between a connector nut, body and post.

It is still another object of the present invention to provide such a coaxial connector that can be manufactured economically.

Another object of my invention is to provide a connector of the character described that establishes satisfactory EMP, EMI, and RFI shielding.

Another important object is to minimize resistive losses in a coaxial cable junction.

A still further object is to provide a connector suitable for use with demanding large, bandwidth systems approximating three GHz.

A related object is to provide an F-connector ideally adapted for home satellite systems distributing multiple high definition television channels.

Another important object is to provide a connector of the character described that is weather proof and moisture resistant.

Another important object is to provide a compression F-connector of the character described that can be safely and properly installed without deformation of critical parts during final compression.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
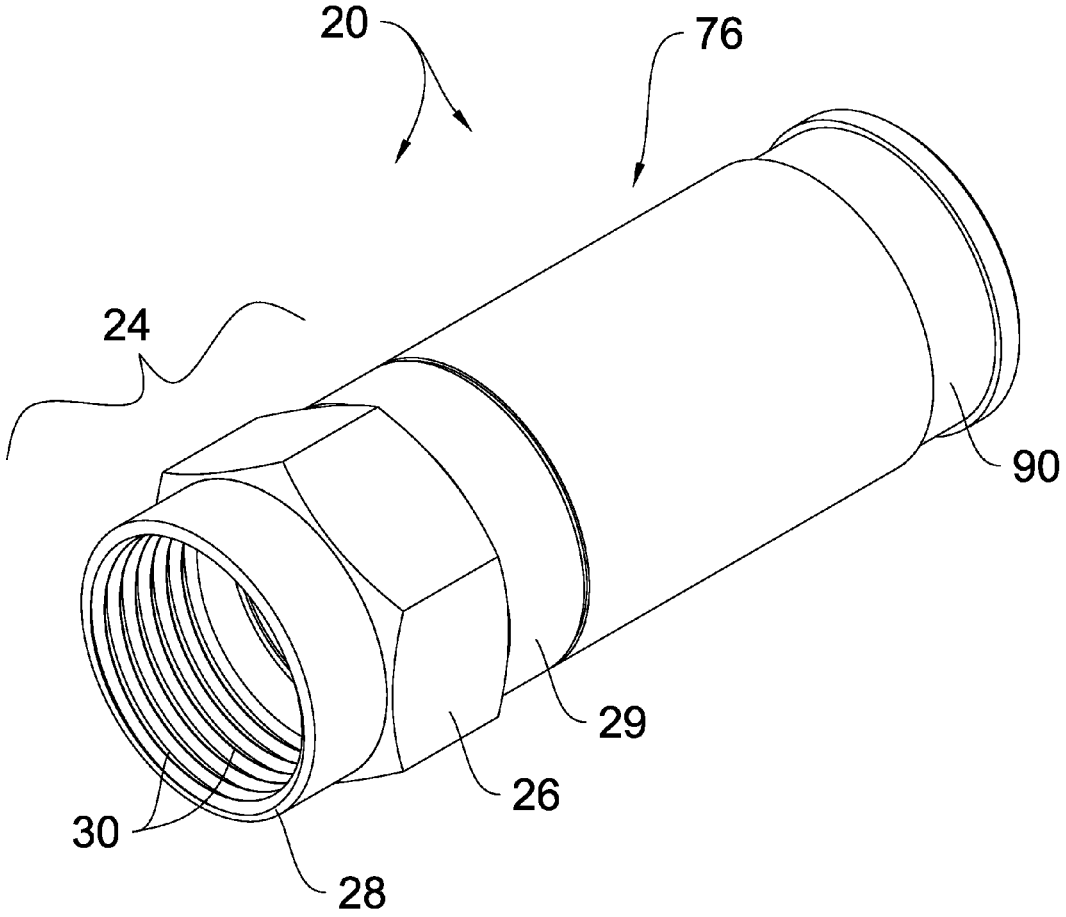
FIG. 1 is a frontal isometric view of a compressed coaxial connector in which the adaptations of my invention are incorporated.
Figure 2:
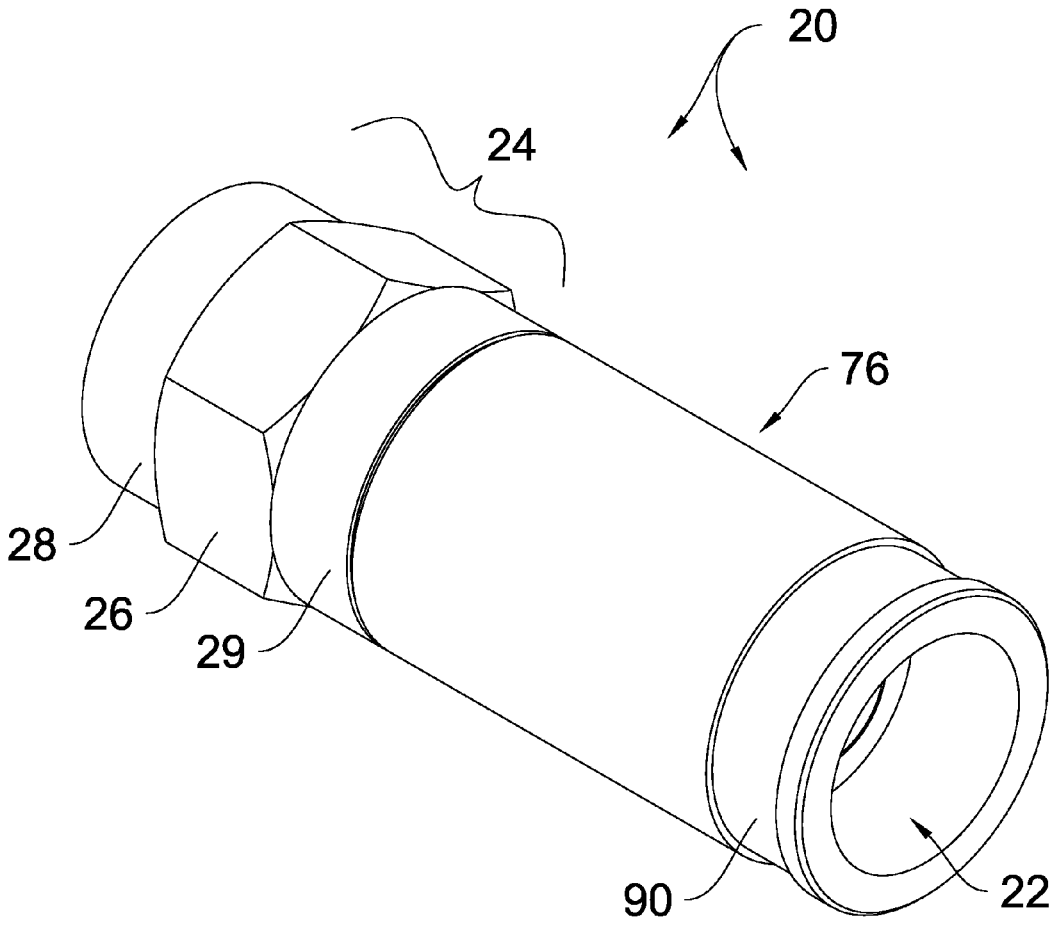
FIG. 2 is a rear isometric view of the connector.

Coaxial cable F-connectors are well known in the art. Various parts similar to those within the compressible coaxial connector of FIGS. 1 and 2 are described in detail, for example, in prior U.S. Pat. No. 7,841,896 entitled "Sealed compression type coaxial cable F-connectors", issued Nov. 30, 2010, and in prior U.S. Pat. No. 7,513,795, entitled "Compression type coaxial cable F-connectors", issued Apr. 7, 2009, which are both owned by the same assignee as in the instant case, and which are both hereby incorporated by reference for purposes of disclosure as if fully set forth herein. However, it will be appreciated by those with skill in the art that coaxial cable connectors of other designs may be employed with the continuity-enhancing inserts and body adaptations described hereinafter.

Referring initially to FIGS. 1-4 of the appended drawings, a coaxial F-connector has been generally designated by the reference numeral 20. As will be recognized by those skilled in the art, connector 20 is a compressible F-connector that is axially squeezed together longitudinally when secured to a coaxial cable. As is also recognized in the art, connector 20 is adapted to terminate an end of a properly prepared coaxial cable, which is properly inserted through the open bottom end 22 (FIG. 2) of the connector 20 prior to compression. Afterwards, the connector 20 is placed within a suitable compression hand tool for compression.

Figure 3:
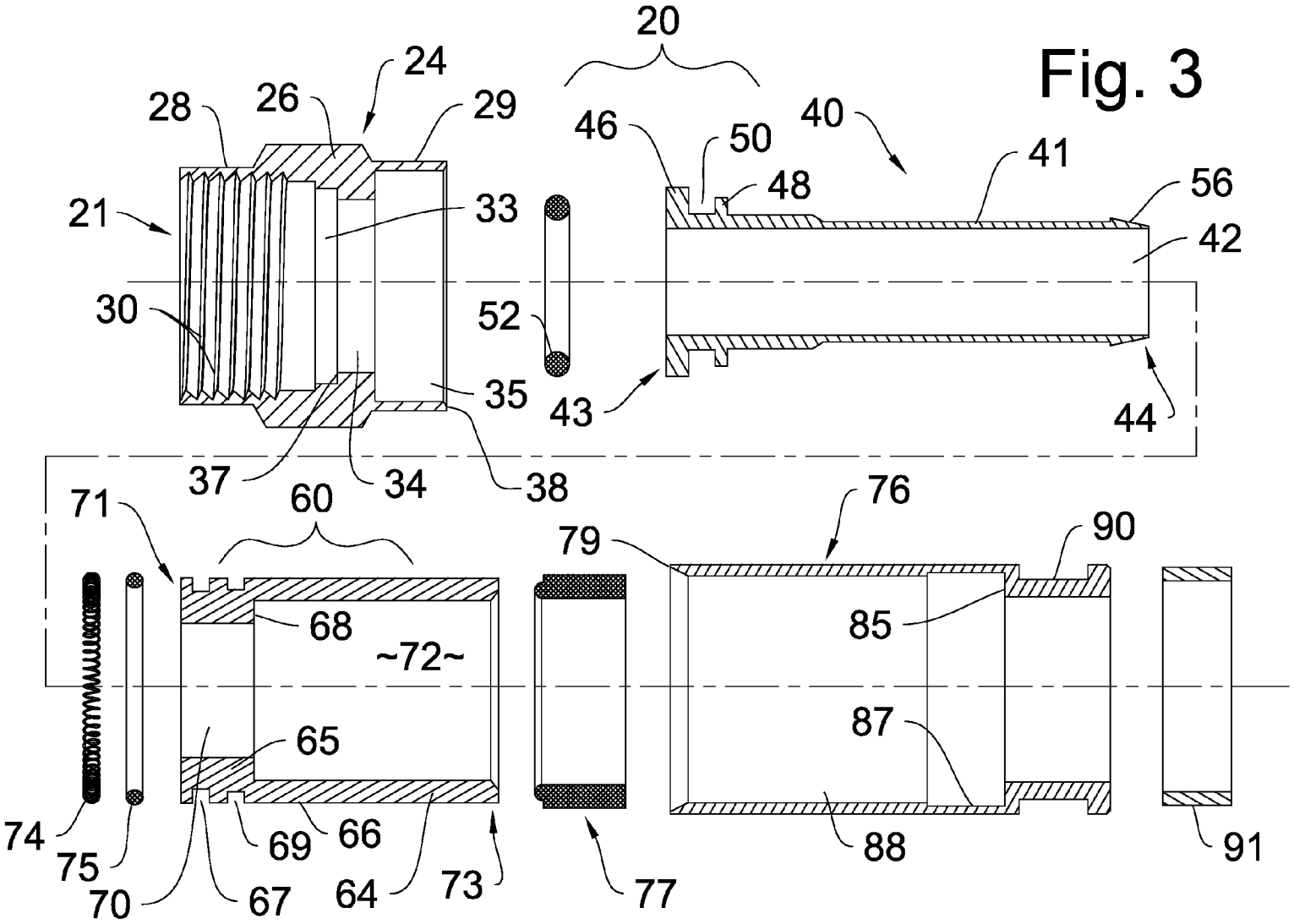
FIG. 3 is an exploded, longitudinal sectional view of the preferred connector.
Figure 4:
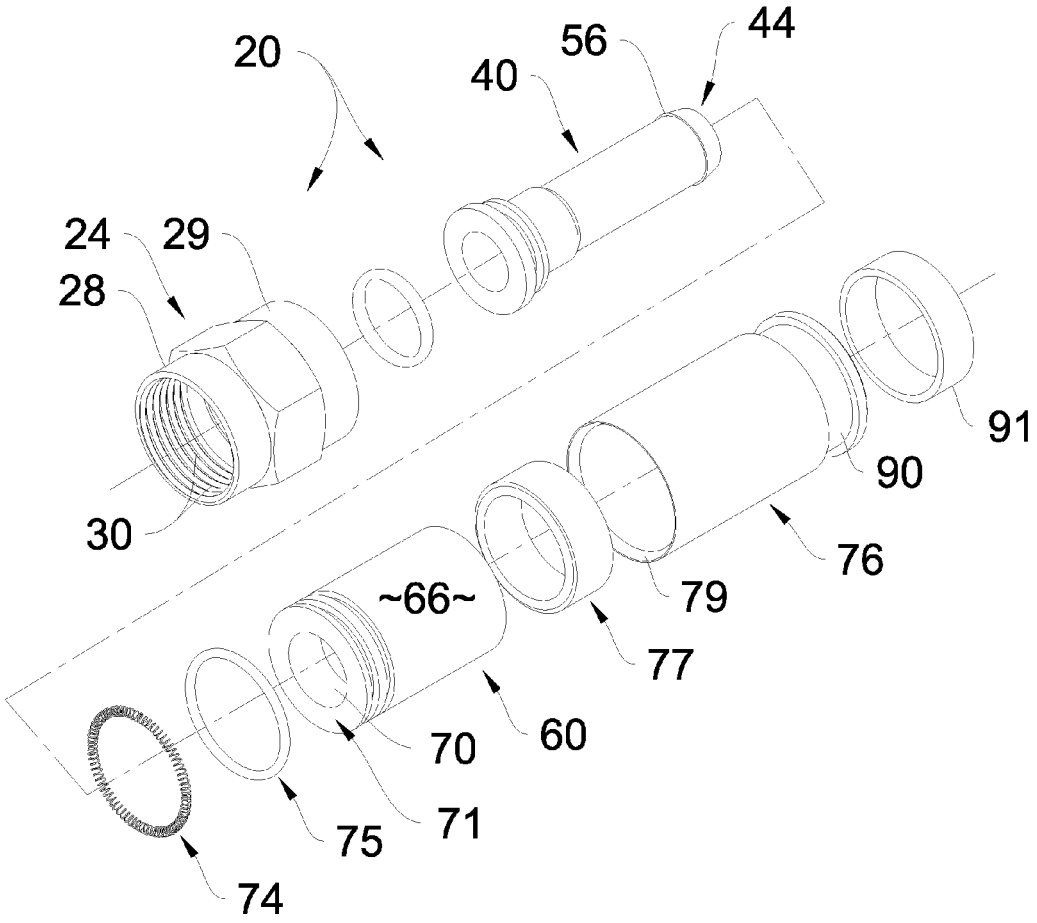
FIG. 4 is an exploded, isometric assembly view of the preferred connector.

Connector 20 comprises a rigid, metallic F nut 24 with a conventional faceted, preferably hexagonal drive head 26 that is integral with a threaded tubular stem 28 at the front of the nut, and a rear mounted, tubular socket 29 at the back of the nut. In some embodiments of the invention tubular socket 29 may have a textured surface to enhance grip when hand tightening the connector 20. As mentioned above, nut 24 is torqued during installation, but proper torquing is problem in the art. Conventional, internal threads 30 are defined in the stem interior for rotatably, threadably mating with a suitably-threaded socket or fitting. The open, tubular front end 21 of the nut 24 connects through the open interior to reduced diameter, internal passageways 33, 34 towards the rear of nut 24 (FIG. 3). Circular passageway 35 at the nut rear is disposed concentrically within tubular socket 29. The annular, internal nut shoulder 37 is disposed between the connected and concentric passageways 33, 34 (FIG. 3). Internal shoulder 37 axially anchors the post in construction as described below. There is a beveled end wall 38 at the rear of the nut socket 29.

In assembly the elongated post 40 coaxially passes through the hex headed nut 24 and establishes electrical contact between the braid of the coaxial cable end (not shown) and the metallic nut 24. The tubular post 40 defines an elongated shank 41 with a coaxial, internal passageway 42 extending between its front 43 (FIG. 3) and rear 44. Shank 41 may or may not have one or more rear barbs 56 formed on it for engaging coaxial cable. An integral, front flange 46 (FIG. 3) borders a spaced-apart, reduced diameter secondary flange 48. A circumferential groove 50 is located between flanges 46 and 48 to seat an O-ring 52 for sealing. Preferably the post 40 has a collar 54 with a diameter slightly greater than the diameter of the post shank 41. The collar 54 coaxially receives the preferably metallic body 60 described below that is press fitted over it in assembly. Preferably the collar 54 is smooth and barbless, unlike prior designs with which I have been associated. However, it may be provided with multiple, external barbs in some embodiments. In assembly it is noted that post flange 46 (i.e., FIGS. 3, 5) axially contacts inner shoulder 37 (FIG. 3) within nut 24, and electrical contact between these parts is established. Further, the O-ring 52 will be compressed slightly to form a seal within passageway 34.

With installation, the rear 44 of post shank 41 penetrates the prepared end of the coaxial cable contacting the metallic shield or sheath, with the inner, insulated center of the coaxial cable coaxially penetrating passageway 42, and entering the nut 24 through socket 29. As recognized by those skilled in the art, the braided shield of the coaxial cable prepared end will be substantially positioned around the exterior of post shank 41 when the connector is compressed. Electrical contact or continuity between the coaxial cable sheath, the post 40, and the nut 24 must be established in use. To enhance the likelihood of establishing reliable continuity, the metallic connector body 60 has been designed to incorporate a continuity insert, described hereinafter, that provides a continuous electrical circuit between the conductive cable sheath, the post 40, and the nut 24.

Figure 6:
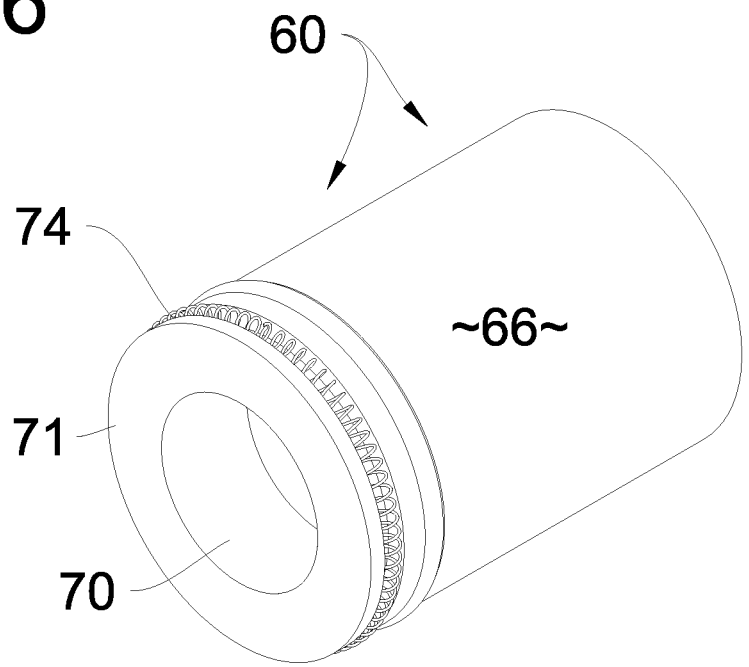
FIG. 6 is a frontal isometric view of the body associated with the preferred connector.
Figure 7:
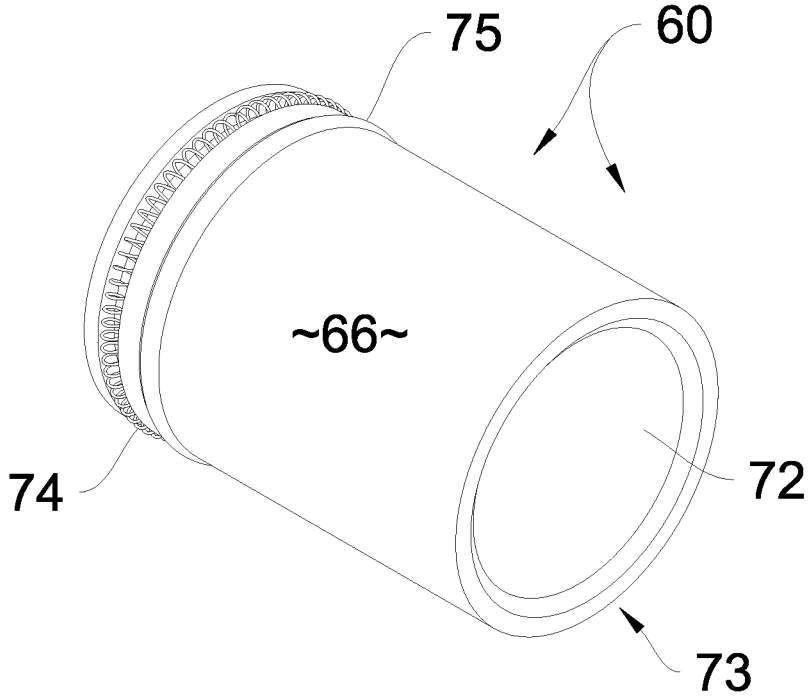
FIG. 7 is a rear isometric view of the preferred connector body.

The elongated, hollow, tubular metallic body 60 (FIGS. 3, 4, 6-7), coaxially fits within the nut socket 29, over the post 40. Body 60 comprises an elongated, tubular shank 64, preferably of a uniform diameter that is integral with the body front base 65 The elongated, outer periphery 66 (i.e., FIGS. 6, 7) of body shank 64 is preferably smooth and cylindrical. Body 60 comprises an internal, coaxial passageway 70 extending through the body front 71 (FIGS. 3, 4, 8) that communicates with the axially adjacent, larger diameter, passageway 72 extending from internal body shoulder 68 to the body rear 73 (FIG. 3). The shorter internal body passageway 70 forms the coaxial center of body base 65. In assembly, (i.e., FIGS. 3, 5) the post 40 will coaxially penetrate passageways 70 and 72, and the post collar 54 will be frictionally secured to base 65 coaxially within body passageway 70 (i.e., FIG. 5).

In a preferred embodiment the body 60 has a pair of spaced apart, external grooves 67 and 69 formed in its base 65. The front groove 67 coaxially seats a conductive insert that promotes grounding and electrical continuity. In this embodiment the insert comprises a generally toroidal continuity coil 74. The adjacent, rear groove 69 preferably seats an O-ring 75 for sealing. It will be noted that in assembly, body base 65 seats within nut socket 29, with a shallow, tubular clearance region 81 concentrically formed therebetween. Continuity coil 74 is compressed within clearance region 81 in assembly (i.e., FIG. 5), bridging the gap between nut socket 29 and the body base 65. Compression of the continuity coil 74 between the nut socket 29 and the body base 65 ensures signal and grounding continuity between the cable conductive sheath, the body 60, the post 40, and the nut 24. O-ring 75 similarly is compressed within this annular region 81, forming a moisture seal.

Figure 5:
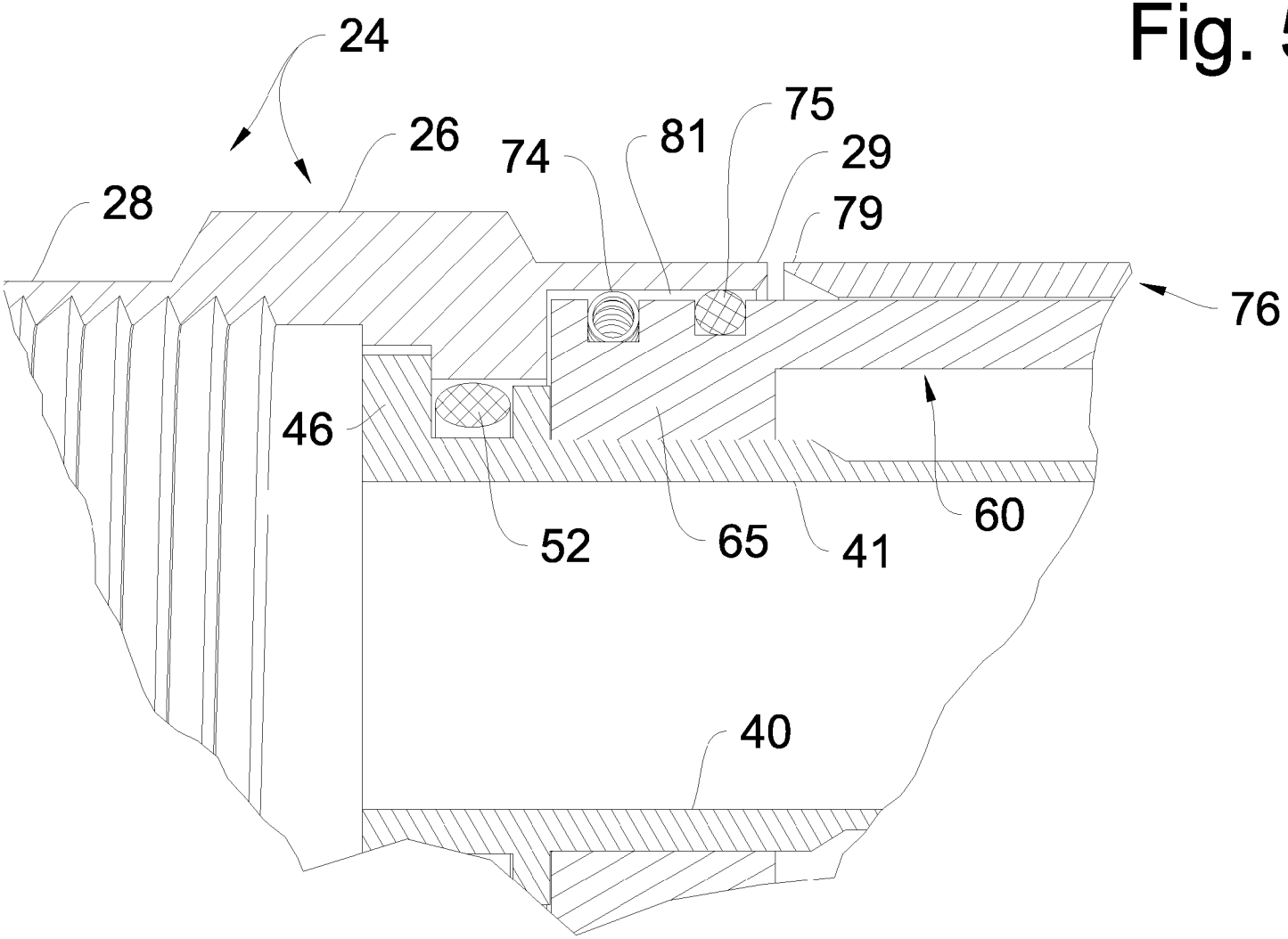
FIG. 5 is an enlarged, fragmentary, longitudinal sectional view showing the preferred connector is a compressed state.

In assembly, an end cap 76 is pressed unto body 60 with a suitable hand-tool. The rigid, preferably metallic end cap 76 smoothly, frictionally grips body shank 64. The end cap passageway 88 is sized to receive coaxial cable. When the end cap 76 is compressed against the body 60 during assembly, a friction fit is achieved. As best seen in FIG. 5, it is preferred that the beveled front end 79 of end cap 76 will terminate just adjacent to the body rear end 73 (FIG. 3) when proper assembly is achieved.

An outer ring groove 90 (i.e., FIG. 4) at the end cap rear can seat an optional external band 91 that can be added to establish a tactile "feel" for the installer. Band 91 can also enhance the aesthetic appearance of the connector, and it can facilitate color coding. Preferably, there is a dual diameter seal 77 seated against shoulder 85 proximate ring groove 87 within end cap 76. Seal 77 is explained in detail in U.S. Pat. No. 7,841,896 issued to Shaw, et. al. on Nov. 30, 2010, entitled "Sealed Compression type Coaxial Cable F-Connectors", which is hereby incorporated by reference for purposes of disclosure as if fully set forth herein. However, with the instant inventions, a variety of different sealing arrangements may be used.

Grounding or continuity is established in part by mechanical and electrical contact between internal nut shoulder 37 (FIG. 3) and post flange 46. The coaxial cable sheath bearing against the post shank 41 thus electrically interconnects with the post and the nut 24, which, in turn, establish electrical contact with the socket to which nut 24 is attached. However, grounding or continuity generally depends on proper tightening of the nut 24. In the real world, installers often neglect to properly tighten the nut 24, so insufficient internal, mechanical pressure is available within the F-connector to urge the parts discussed above into mechanically abutting, electrically conductive contact. Accordingly, each connector described herein includes means seated within the body groove 67 that establishes both mechanical and electrical contact between nut 24 (i.e., socket 29) and body 60 (i.e., base 65).

Figure 8:
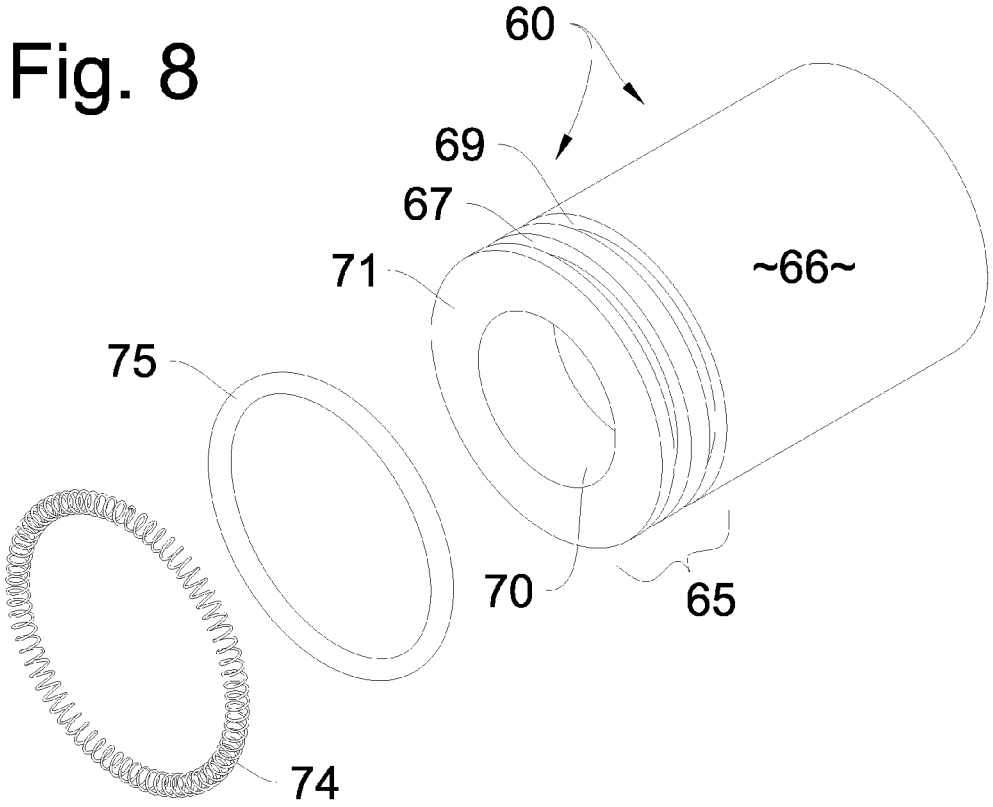
FIG. 8 is an exploded, isometric view of the connector body of FIGS. 6 and 7.
Figure 9:
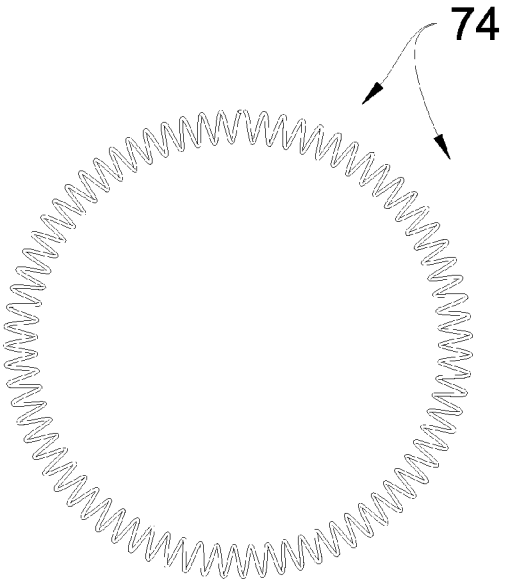
FIG. 9 is a front plan view of a preferred continuity insert used with the body of FIGS. 6-8.

As best viewed in FIGS. 8 and 9, the continuity coil 74 resembles an O-ring, and is generally toroidal. The coil 74 is made of a looped, length of coiled wire. The coil 74 has a circular cross section, as appreciated from FIG. 8, and forms a circle, as seen in FIG. 9. In assembly, coil 74 sits within body 67 groove (i.e., FIGS. 3, 8), and frictionally contacts the peripheral, surrounding tubular socket 29 projecting integrally rearwardly from nut 24. At the same time, post flange 46 contacts internal nut shoulder 37 (FIG. 5).

Preferably, continuity coil 74 is made from phosphor bronze or a similar conductive metallic alloy. The outside diameter of the coil 74 is fractionally larger than the depth of the groove 67 in which it coaxially rests. The coil 74 is therefore in spring-loaded contact with both the nut socket 29 and the body base 65. Electrical contact between the nut 24 and the metallic body 60 is thus encouraged, and continuity is therefore assured, even if nut 24 is not fully torqued and seated against the mating, female threaded target. A less-than-perfect torque application of the nut 24 during installation will not necessarily result in an electrical ground continuity failure with continuity coil 74 installed.

Figure 10:
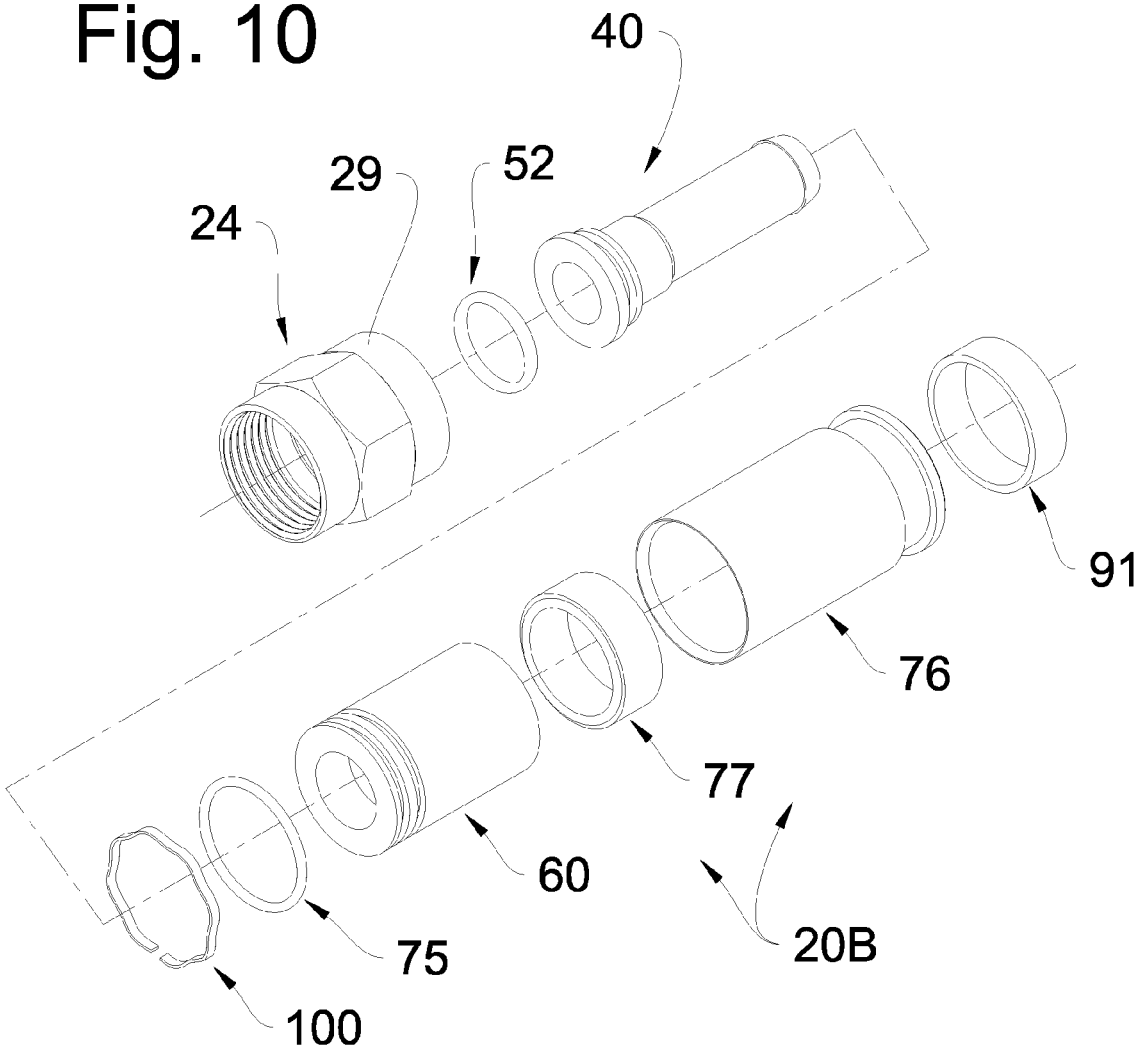
FIG. 10 is an exploded, isometric assembly view of an alternative connector embodiment employing an alternative continuity insert.

An alternative connector embodiment 20B is seen in FIG. 10. Connector 20B comprises all of the aforementioned parts discussed above, except that the preferred grounding insert comprises a resilient, continuity washer 100 that has been substituted for the previously described continuity coil 74.

Figure 11:
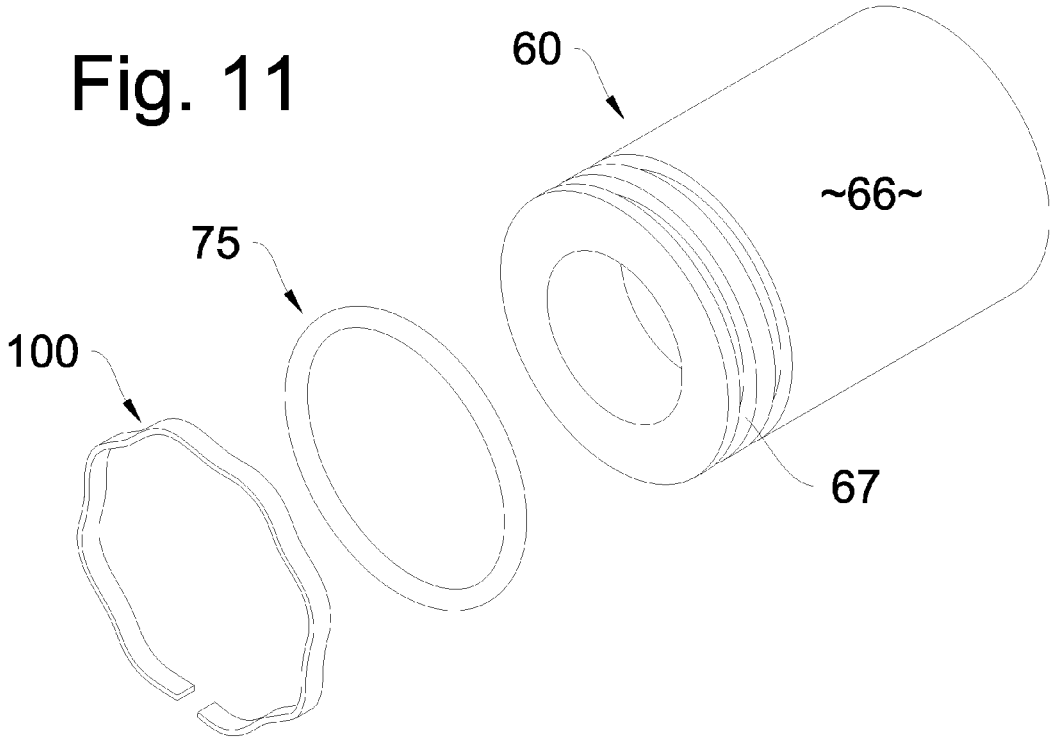
FIG. 11 is an exploded, isometric view of the alternative body construction used with the connector of FIG. 10; and, FIG. 12 is a front plan view of the alternative continuity insert used with the body of FIGS. 10-11.
Figure 12:
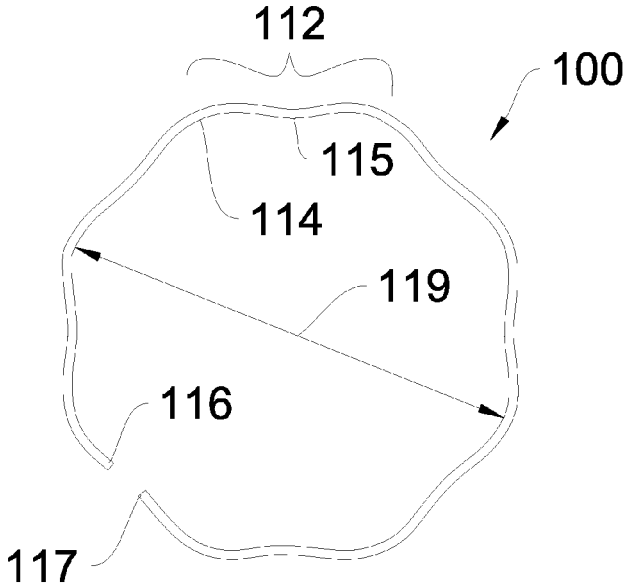

Referring jointly to FIGS. 10-12, the continuity washer 100 is generally circular in a plan view. It is adapted to seat within groove 67 within body 60 (i.e., FIG. 11), and frictionally contacts the surrounding nut socket 29. The continuity washer 100 may be fashioned from a flat, rectangular length of phosphor-bronze material that has been shaped into a slightly sinusoidal pattern. When formed into a circle as in FIG. 12, the sinusoidal patterns present a somewhat petal shaped or faceted appearance. In other words, to add springiness, the continuity washer 100 has a plurality of regularly spared apart facets 112, forming a polygonal appearance. Each facet 112 has a pair of outwardly projecting bends 114 bordered by inwardly projecting valleys 115. In a preferred embodiment, the washer's terminal ends 116, 117 are spaced apart and not connected.

Preferably, the continuity washer 100 is made from phosphor bronze or a similar conductive metallic alloy. The maximum outside diameter 119 (FIG. 12) of the washer 100, corresponding to the distance between two diagonally opposite bends 114, is fractionally larger than the depth of body groove 67. The washer valleys 115 seat within the body groove 67. The washer 100 therefore establishes yieldable spring-biased contact with both the nut socket 29 and the body base 65 to promote electrical contact between the nut 24 and the metallic body 60 and ensure signal and grounding continuity between the conductive cable sheath, the body 60, the post 40, and the nut 24. Therefore, even with insufficient torquing of the nut 24 during installation, electrical grounding and continuity are established.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compressible coaxial connector comprising:
- a nut adapted to threadably fasten the connector, the nut comprising a tubular rear socket;
- an elongated, metallic post with a flange that internally abuts the nut;
- a hollow, tubular metallic body coaxially disposed over said post and coaxially received by said socket;
- a metallic grounding insert coupled to said body that establishes continuity within said socket; and,
- a circumferential body surface flanked by raised, generally opposed body walls forming a first groove that receives the grounding insert.

2. The connector of claim 1 further comprising:
- a second groove adjacent to the first groove and an O-ring deposited within said second groove.

3. The connector of claim 2 wherein the O-ring is not an electrical conductor.

4. The connector of claim 2 wherein the grounding insert is located between the O-ring and the post flange.

5. A compressible coaxial connector comprising:
- a nut adapted to threadably fasten the connector, the nut comprising a tubular rear socket;
- an elongated, metallic post with a flange that internally abuts the nut;
- a hollow, tubular metallic body coaxially disposed over said post and coaxially received by said socket; and,
- a metallic grounding insert coupled to said body that establishes continuity within said socket;
- wherein the socket receives a body end portion having a constant outside diameter but for first and second body grooves separated by a common septum.

6. A compressible coaxial connector comprising:
- a nut adapted to threadably fasten the connector, the nut comprising a tubular rear socket;
- an elongated, metallic post with a flange that internally abuts the nut;
- a hollow, tubular metallic body coaxially disposed over said post and coaxially received by said socket;
- a metallic grounding insert coupled to said body that establishes continuity within said socket;
- a body wall located between the grounding insert and the nut;
- the body wall for preventing longitudinal contact between the grounding insert and the nut; and,
- the body wall for preventing the grounding insert from exerting a longitudinal force on the nut.

7. A compressible coaxial connector comprising:
- a nut and a socket extending from the nut, both in coaxial arrangement with a connector longitudinal axis;
- an elongated, metallic post including a flanged end that internally abuts the nut;
- a hollow, tubular metallic body coaxially disposed over said post and coaxially received by said socket;
- an electrical conductor protruding from a three sided circumferential groove in a body end received by the socket; and,
- the socket inside diameter constantly diametrically contacted by the electrical conductor.

8. The connector of claim 7 further comprising:

a coil formed from the electrical conductor.

9. The connector of claim 8 further comprising:

a torroidal coil formed from the coil.

10. The connector of claim 7 wherein the electrical conductor is wire and a groove forward sidewall prevents axial contact between the nut and a torroidal continuity coil made of a wire coil.

11. The connector of claim 7 wherein a first body wall is interposed between the electrical conductor and an O-Ring encircling the body.

12. The connector of claim 11 wherein a second body wall is interposed between the electrical conductor the post flanged end.

13. A compressible coaxial connector comprising:

in coaxial arrangement, a post, a nut, a tubular body, and a torroidal coil;

the tubular body is inserted in the nut and the post rotatably couples the nut and the tubular body;

the torroidial coil captured between first and second opposed body walls extends across a radial gap between the body and the nut; and, the torroidal coil electrically interconnects the body and the nut.

14. The connector of claim 13 further comprising:

a first O-Ring captured between second and third opposed body walls extends across the radial gap between the body and the nut; and, a second O-Ring between first and second post flanges extends radially to contact the nut.

15. The connector of claim 13 wherein the torroidal coil is a wire helix that is looped to form a torus.

* * * * *